US007316270B2

(12) United States Patent
Shen

(10) Patent No.: US 7,316,270 B2
(45) Date of Patent: Jan. 8, 2008

(54) OIL PUMPING UNIT USING AN ELECTRICAL SUBMERSIBLE PUMP DRIVEN BY A CIRCULAR LINEAR SYNCHRONOUS THREE-PHASE MOTOR WITH RARE EARTH PERMANENT MAGNET

(75) Inventor: Kuei-Hsien Shen, Hsichih (TW)

(73) Assignee: Digitek Technology Co., Ltd., Taipei County (TW)

( * ) Notice: Subject to any disclaimer, the term of this patent is extended or adjusted under 35 U.S.C. 154(b) by 132 days.

(21) Appl. No.: 11/285,039

(22) Filed: Nov. 23, 2005

(65) Prior Publication Data

US 2007/0114015 A1 May 24, 2007

(51) Int. Cl.
*E21B 43/00* (2006.01)
*F04B 17/04* (2006.01)

(52) U.S. Cl. ..... 166/105; 166/66.4; 166/68; 417/416

(58) Field of Classification Search ..... 166/105, 166/68, 66.4–66.7; 417/410.1, 417, 416
See application file for complete search history.

(56) References Cited

U.S. PATENT DOCUMENTS

| | | | | |
|---|---|---|---|---|
| 1,655,825 | A * | 1/1928 | Schmidt | 417/417 |
| 4,538,970 | A * | 9/1985 | Rabson | 417/417 |
| 4,687,054 | A * | 8/1987 | Russell et al. | 417/417 |
| 4,768,595 | A * | 9/1988 | Smith | 166/369 |
| 5,960,875 | A * | 10/1999 | Beauquin et al. | 166/66.4 |
| 6,817,409 | B2 * | 11/2004 | Howard | 166/108 |

* cited by examiner

*Primary Examiner*—Kenneth Thompson
(74) *Attorney, Agent, or Firm*—Rosenberg, Klein & Lee

(57) ABSTRACT

An oil pumping unit is disclosed to include a motor, which has a mover that moves alternately up and down when the motor is electrically connected, and a pump, which has a barrel, an oil suction pipe mounted in the barrel, an inner sleeve, which is connected to the suction pipe and has installed therein a mixing valve, a movable valve and a piston, a bottom one-way oil intake valve, and a one-way mixing flow intake valve respectively arranged in such a manner that when the mover is operated to reciprocate the oil suction pipe, crude oil is alternately pumped through the one-way bottom oil intake valve and the one-way mixing flow intake valve to alternately pass through the movable valve and the mixing valve to the ground.

4 Claims, 3 Drawing Sheets

OIL PUMPING UNIT USING AN ELECTRICAL SUBMERSIBLE PUMP DRIVEN BY A CIRCULAR LINEAR SYNCHRONOUS THREE-PHASE MOTOR WITH RARE EARTH PERMANENT MAGNET

BACKGROUND OF THE INVENTION

1. Field of the Invention

The present invention relates to an oil artificial lift unit for oil production and more particularly, to an oil artificial lift unit that uses an electrical submersible pump driven by a circular linear synchronous three-phase motor with rare earth permanent magnet.

2. Description of the Related Art

An oil artificial lift device is a device that transforms rotary mechanical energy to linear mechanical energy and in turn pumps the oil from underground to ground surface. Presently there are many artificial lift technologies available. They have their advantages as well as shortcomings. Currently available electrical submersible pump uses a rotary motor to rotate a vane wheel, thereby pumping cruel oil to the ground surface. In general, an electrical submersible pump is used on large quantity oil production well. It is easy to manage but its initial investment as well as its electrical consumption is high. Progressive cavity pump requires less initial investment with broader application. However, this progressive cavity pump lasts shorter with higher breakdown rate. The most popular artificial lift today is beam/sucker-rod pumping comprising a motor-driven surface system lilting sucker rods within the tubing string to operate a downhole reciprocating pump. Beam pumping is durable with low breakdown rate, however, it has the drawbacks of complicated structure, low performance, and high electric energy consumption.

SUMMARY OF THE INVENTION

It is an object of the present invention to provide an oil pumping unit, which uses a circular linear synchronous motor to reciprocate a pump, causing the pump to pump crude oil from the oil well to the ground surface continuously during the down stroke as well as the up stroke. It is another object of the present invention to provide an oil pumping unit, which uses a linear motor to reciprocate an oil suction pipe, causing the oil suction pipe to suck and deliver crude oil during the operation of the linear motor.

DETAILED DESCRIPTION OF THE PREFERRED EMBODIMENT

Figure 1:
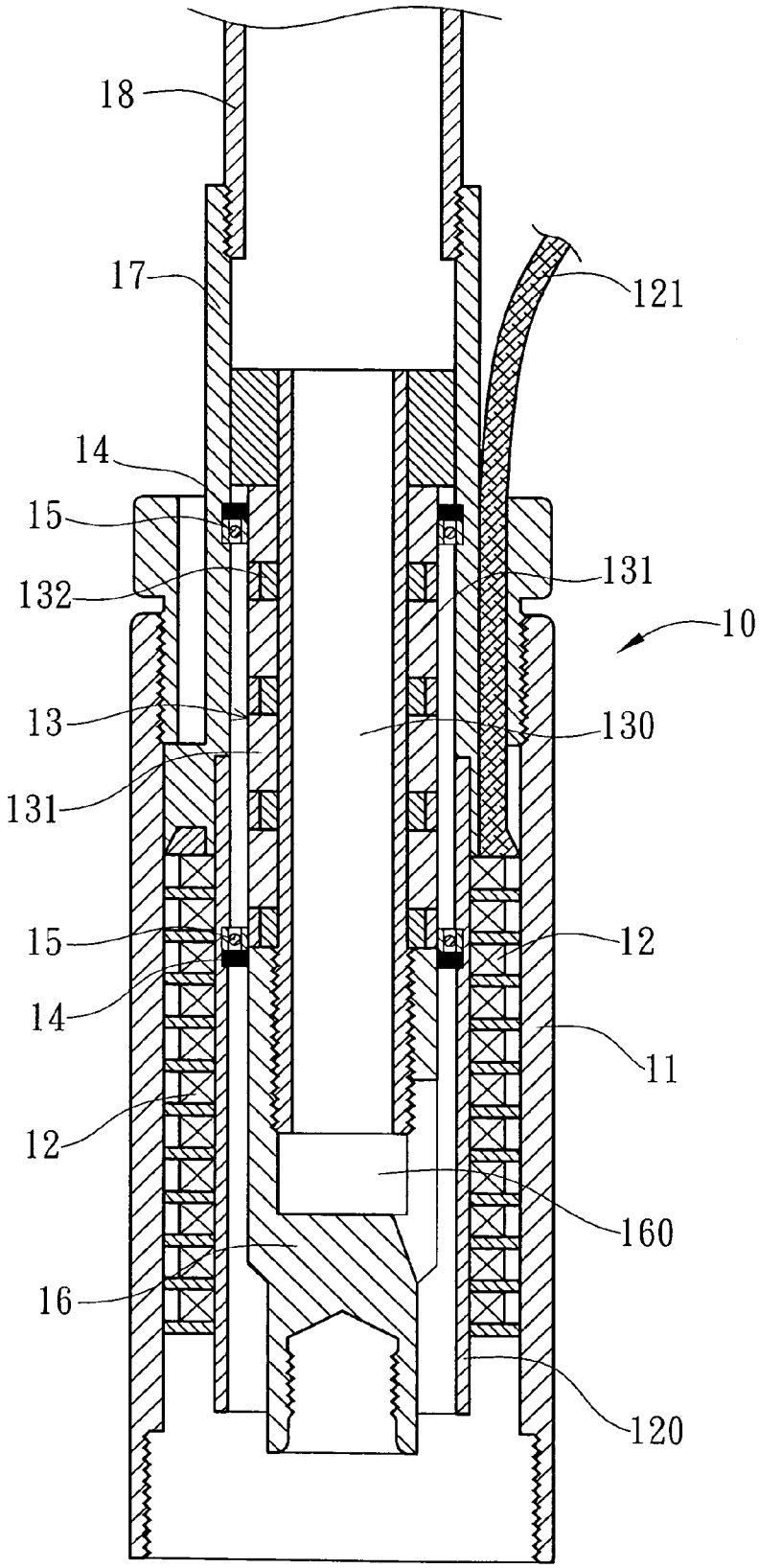
FIG. 1 is a sectional view of a motor for an oil pumping unit according to the present invention.
Figure 2:
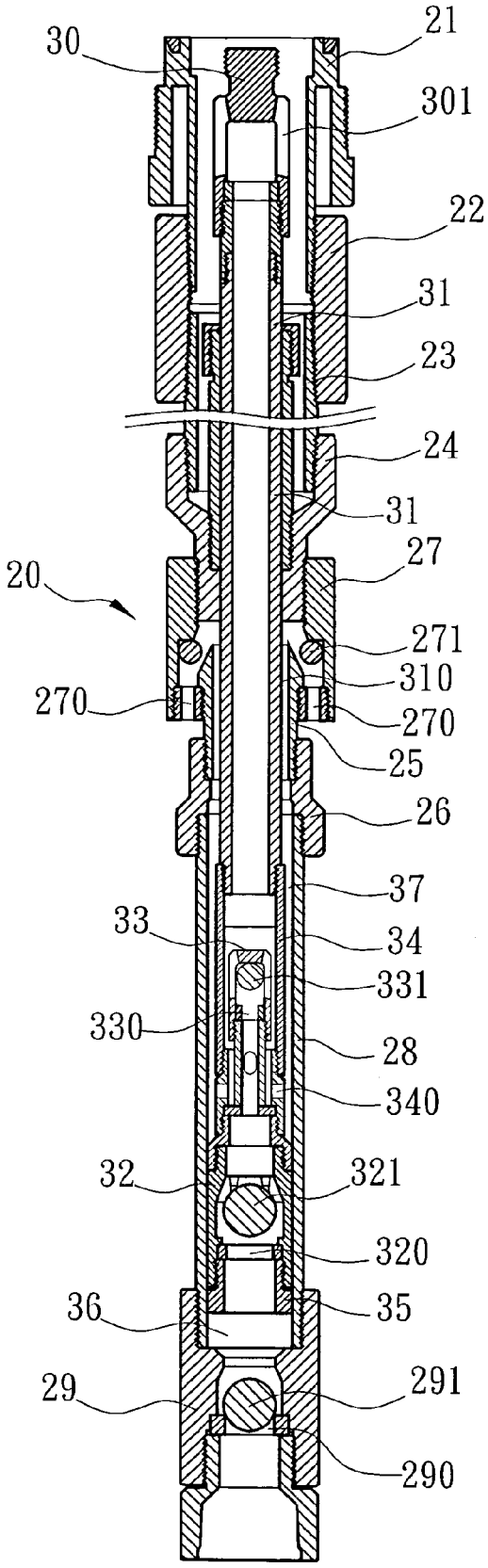
FIG. 2 is a sectional view of a pump for an oil pumping unit according to the present invention.

Referring to FIGS. 1-4, an oil pumping unit in accordance with the present invention is shown comprised of a motor 10 and a pump 20.

The motor 10 comprises a casing 11, a stator 12, and a mover 13. The mover 13 has an inner tube 130, which has outlet at the upper end to an oil delivery pipe 18 and connection at the lower end to a connector 16 that has an oil hole 160. The stator 12 has a power cable 121 connected to power supply. When power supply to the motor 10 is on through power cable 121, the mover 13 and the connected connector 16 are moved up and down.

The pump 20 comprises a barrel formed of a motor connector 21, a socket connector 22, a plurality of inner sockets 23 and 25, a plurality of outer sockets 24 and 26, and an outer sleeve 28. An oil suction pipe 31 is mounted in the barrel of the pump 20. The oil suction pipe 31 has a top end threaded connector 30, which has an oil hole 301, and the bottom end is connected to an inner sleeve 34, which has installed therein a mixing valve 33, a movable valve 32 and a piston 35. The outer sleeve 28 has the bottom end provided with a bottom one-way oil intake valve 29. The oil suction pipe 31 matches with the inner socket 25 to hold a one-way mixing flow intake valve 27. The inner socket 25 and the oil suction pipe 31 define an oil passage 310, which is disposed in communication with a piston upper chamber 37 that is defined in between the outer sleeve 28 and the inner sleeve 34. The piston upper chamber 37 has an oil hole 340 disposed in communication with the mixing valve 33. When oil is entering the one-way mixing flow intake valve 27, it passes through the oil passage 310 to the piston upper chamber 37 and then the oil suction pipe 31 via the mixing valve 33.

The motor connector 21 of the pump 20 is connected to the casing 11 of the motor 10. The connector 30 of the pump 20 is connected to the connector 16 of the motor 10, therefore the oil suction pipe 31 of the pump 20 is reciprocated with the mover 13 during operation of the motor 10.

The bottom one-way oil intake valve 29 has an oil hole 290 and a one-way valve ball 291 in the oil hole 290. The mixing valve 33 and the movable valve 32 have respectively oil hole 330 mounted with one-way valve 331 and oil hole 320 mounted with one-way valve ball 321. Therefore, oil is only allowed to flow in but not to flow out suction pipe 31.

The one-way mixing flow intake valve 27 has an oil hole 270 mounted with a one-way valve ball 271, allowing oil to flow in through the oil hole 270 in one direction only.

Referring to FIG. 1 again, the motor 10 comprises a locating tube 17, a bush 120 fastened to the locating tube 17, bearings 15 and oil seals 14 fastened to the bush 120 to support the mover 13, and rare earth permanent magnets 132 mounted around the inner tube 130 of the mover 13. The stator 12 is formed of a set of silicon steel plates and windings mounted around the bush 120. When power is on to the motor through power cable 121, the silicon steel plates of the stator 12 produce a magnetic field that acts upon the permanent magnets 132, thereby causing a reciprocating motion of the mover 13 and the connector 16. The length of the linear motor is determined subject to the horsepower required. The longer the stator and mover of the motor are, the greater the horsepower will be. The reciprocating frequency of the linear motor is adjustable by means of controlling the power frequency to the motor by a variable frequency controller.

Figure 4:
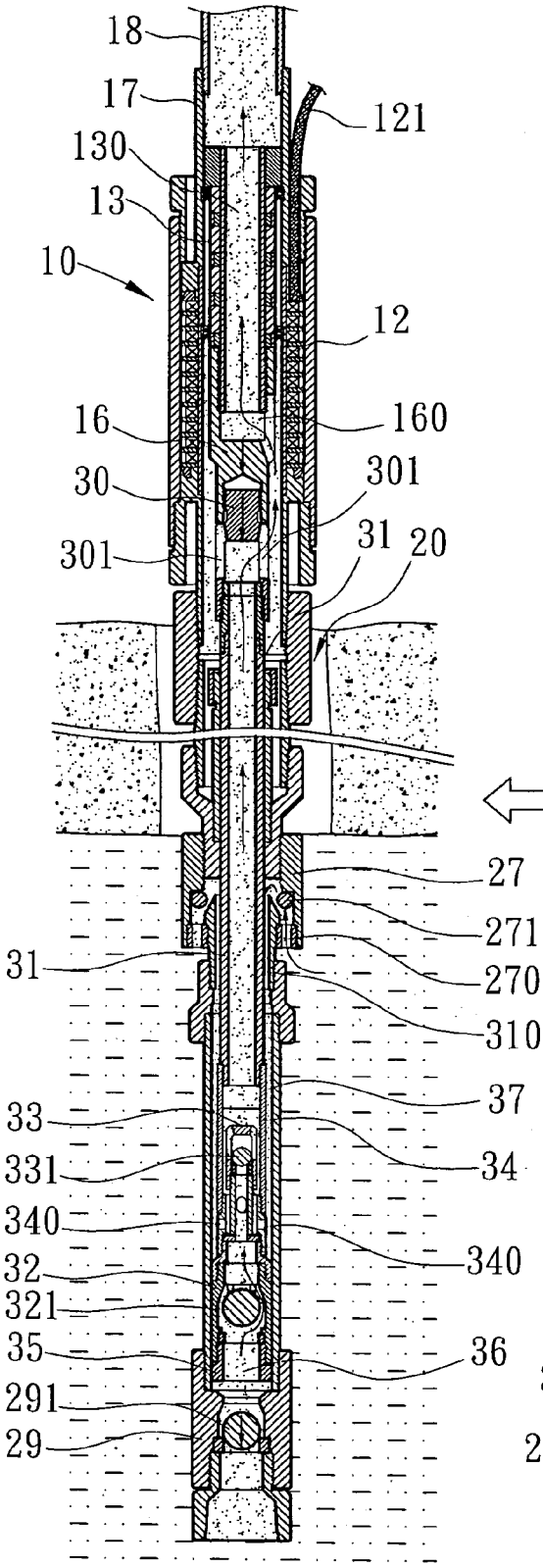
FIG. 4 is a schematic sectional view of the present invention, showing the down stroke of the oil suction pipe of the oil pumping unit
Figure 3:
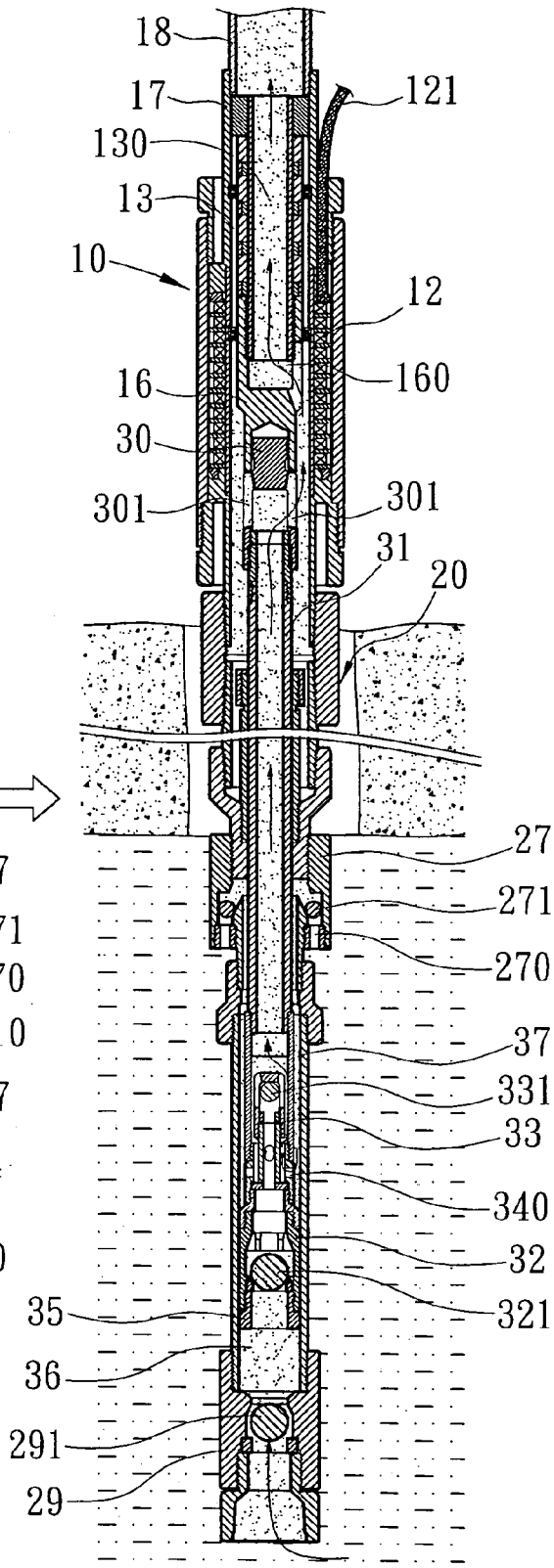
FIG. 3 is a schematic sectional view of the present invention, showing the up stroke of the oil suction pipe of the oil pumping unit.

During the down stroke as well as the up stroke of the oil suction pipe 31 of the pump 20, the oil pumping unit pumps oil from the oil well to the ground surface. As shown in FIG. 3, the oil suction pipe 31 and the piston 35 are lifted when the mover 13 of the motor 10 is lifted. As a result, the piston bottom chamber 36 is expanded and the pressure inside the chamber is lowered. The oil is then sucked into the piston bottom chamber 36 through the one-way bottom oil intake valve 29. At the same time, the piston upper chamber 37 is compressed to reduce the volume and to increase the pressure inside, thereby closing the one-way mixing flow intake valve 27 and the movable valve 32 and opening the one-way mixing valve 33 for enabling cruel oil to pass from the piston upper chamber 37 through the oil hole 340 and the one-way mixing valve 33 into the oil suction pipe 31. Oil further flows from the oil suction pipe 31 through the oil hole 301 and oil hole 160 to the oil delivery pipe 18 via the inner tube 130. As shown in FIG. 4, when the mover 13 of the motor 10 moves downward, the oil suction oil 31 and the piston 35 move downward as well. At this downward process, the piston bottom chamber 36 is compressed so that the pressure inside is increased. As a result the one-way bottom oil intake valve 29 will be closed and the movable valve 32 will be opened. Oil in the piston bottom chamber 36 can then flow through the piston movable valve 32 to the oil suction pipe 31. Oil flows further from the oil suction pipe 31 through the oil hole 301 and the oil hole 160 to the oil delivery pipe 18 via the inner tube 130. At the same time, the piston upper chamber 37 is expanded and the pressure inside is lowered. The one-way mixing flow intake valve 27 is then opened and the mixing valve 33 is closed so that oil can flow through the one-way mixing flow intake valve 27 to the piston upper chamber 37. Therefore, the oil suction pipe moves up and down to deliver oil to the ground surface in both up and down during reciprocating motion of the mover 13 of the motor 10.

Further, the invention can be made in such a way that the pump is at the top of the linear synchronous three-phase motor Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. An oil artificial lift pumping unit comprising:

a motor, said motor comprising a casing, a stator, and a mover, said mover having an inner tube, which has one end connected to an oil delivery pipe and an opposite end connected to a first connector, which has a first oil hole, said stator having a power cable connected to a power supply for causing said mover and the first connector to move alternately up and down; and a pump, said pump comprising a barrel, an oil suction pipe mounted in said barrel, said oil suction pipe having a top end having a second threaded connector, which has a second oil hole, and a bottom end connected to an inner sleeve, which has installed therein a mixing valve, an axially movable valve and a piston, an outer sleeve having a bottom end provided with a bottom one-way oil intake valve, said oil suction pipe matching with an inner socket to hold a one-way mixing flow intake valve, said inner socket and said oil suction pipe defining an oil passage, which is disposed in communication with a piston upper chamber that is defined in between said outer sleeve and said inner sleeve, said piston upper chamber having a third oil hole disposed in communication with said mixing valve;

wherein when said mover of said motor is operated to reciprocate said oil suction pipe, crude oil is alternately pumped through said one-way bottom oil intake valve and said one-way mixing flow intake valve to alternately pass through said axially movable valve and said mixing valve to the ground surface.

2. The oil artificial lift pumping unit as claimed in claim 1, wherein said motor further comprises a locating tube, a bush fastened to said locating tube, bearings and oil seals fastened to said bush to support said mover, and rare earth permanent magnets mounted around said inner tube of said mover; said stator is formed of a set of silicon steel plates and a winding and is mounted around said bush.

3. The oil artificial lift pumping unit as claimed in claim 1, wherein said barrel is formed of a motor connector, a socket connector, a plurality of inner sockets, a plurality of outer sockets, and said outer sleeve.

4. The oil artificial lift pumping unit as claimed in claim 1, wherein said motor is a three-phase linear synchronous motor, and said pump is provided at a bottom side of said three-phase linear synchronous motor.

* * * * *